United States Patent [19]

Kolpakov et al.

[11] 4,214,856

[45] Jul. 29, 1980

[54] APPARATUS FOR LINING LADLES

[76] Inventors: Serafim V. Kolpakov, ulitsa Ryazanskaya, 12; Zinovy L. Gurkov, ulitsa Parkovaya, 4, kv. 42; Oleg L. Bondarenko, ulitsa M. Gorkogo, 13/2, kv. 1; Vladimir V. Valtsov, ulitsa Anosova, 2, kv. 25; Alexandr M. Pozhivanov, ulitsa Zhelyabova, 16, kv. 8; Eduard D. Gugnin, ulitsa Gagarina, 167, kv. 8; Stanislav V. Radilov, ulitsa Tereshkovoi, 38b, kv. 34; Alexandr A. Bogdanov, ulitsa Parkovaya, 6, kv. 4, all of Lipetsk, U.S.S.R.

[21] Appl. No.: 894,387

[22] Filed: Apr. 7, 1978

Related U.S. Application Data

[60] Division of Ser. No. 691,079, May 28, 1976, Pat. No. 4,094,938, which is a continuation of Ser. No. 449,466, Mar. 8, 1974, abandoned.

[51] Int. Cl.[2] ..... F27D 1/16

[52] U.S. Cl. ..... 425/60; 425/141; 425/147

[58] Field of Search ..... 425/60, 138, 140, 141, 425/147; 264/30, 309

[56] References Cited

U.S. PATENT DOCUMENTS

| | | | |
|---|---|---|---|
| 2,979,798 | 4/1961 | Price | 425/60 |
| 3,672,649 | 6/1972 | Allen | 264/30 X |
| 3,716,316 | 2/1973 | Dekker | 264/30 X |
| 3,779,679 | 12/1973 | Bisinella | 425/60 X |

*Primary Examiner*—Thomas P. Pavelko
*Attorney, Agent, or Firm*—J. Harold Nissen

[57] ABSTRACT

An apparatus for delivering a refractory mass with a sand-blast head along a ladle-lining surface and parallel thereto in a ladle. The sand-blast head is provided with a movement inside the ladle so as to continuously fill the lining along a helical trajectory and over the entire height of the ladle from the bottom to the top. For this purpose, the apparatus is mounted on a platform installed inside the ladle on a hollow supporting rod through which the mass is fed to the sand-blast head. Provision is made for a contact sensor which senses the current level of the lining plane, and controlled drives of the platform rotation, rod lifting and change in the radial jet of the mass thrown out of the sand-blast head.

9 Claims, 7 Drawing Figures

APPARATUS FOR LINING LADLES

This is a division of the applicants' earlier application Ser. No. 691,079, filed May 28, 1976 now U.S. Pat. No. 4,094,938 entitled "Method and Apparatus for Lining Ladles" which was a continuation of applicants' earlier application Ser. No. 449,466, filed Mar. 8, 1974, entitled "Method for Lining Ladles and Apparatus for Effecting Same", now abandoned.

The present invention relates to the technology of making linings of steel-teeming or mixing ladles, ladles adapted to handle non-ferrous metals, as well as steel furnaces of a circular cross-section.

More particularly, the present invention relates to an apparatus for lining the said and similar objects with a refractory mass fed from a sand-blast head, and an apparatus for carrying out the method.

Known are several methods for lining the ladles with a refractory mass (cf. "Tchernye Metally", No. 16, p. 11, 1969; Translation No. 6600 of the catalogue of the Badische Machinenfabrik Company, Tchermetinformatzia, 1971), according to which methods the refractory mass is tramped by a sand-blast head in the space confined by the ladle wall, and a special pattern is inserted in the ladle.

In accordance with this conventional technology the lining is tramped from below while the sand-blast head is disposed at the top, which makes the refractory mass thrown out of the sand-blast head at a high speed passing through a narrow slot over a rather long distance before it gets onto the lining base surface. In this case the possibility of the refractory mass partial flow hitting against the ladle wall or the pattern is not excluded, which reduces the speed of the mass flow and results in a worse quality of the lining at the lower portion of the ladle.

Besides, the lining quality depends upon many other factors such as moisture content of the refractory mass, the degree to which the sand-blast head is loaded, and the rate of displacement of the sand-blast head relative to the lining plane. The optimum values of these parameters should vary within narrow limits, as a deviation of at least one of them from the optimum value leads to a poor-quality lining.

In the conventional methods the lining is tramped by only one active force, i.e. the impact force developed by the sand-blast head and applied along the wall of the ladle.

Also known is an apparatus employing a sand-blast head for successively lining ladles by separate circular layers.

In the conventional apparatus the ladle is turned relative to the sand-blast head and a shaping support, the sand-blast head is imparted a step-like rise, and the refractory mass is thrown at an acute angle with respect to the surface of the ladle walls being lined (cf. French Patent No. 1,483,584).

The conventional apparatus has a number of disadvantages, for instance, that the successive step-like filling of tramped lining rings in turn results in a lower efficiency of the apparatus.

Rejection of the refractory mass by the sand-blast head at an acute angle relative to the surface of the ladle wall being lined decreases the degree of the mass tramping in the space between the ladle wall and the support, and may lead to a considerable scattering of the refractory mass.

Besides, the rotation of the ladle being lined relative to the sand-blast head results, on the one hand, in technological and structural difficulties encountered when centering and supporting the ladle, and, on the other hand, in a more limited field of application of the apparatus for lining ladles of a relatively large size and weight.

The main object of the present invention consists in the provision of an apparatus for the filling of linings that makes it possible to obtain a high-quality lining of ladles along the entire height thereof owing to a uniform and high density of the lining effective layer.

Another object of the present invention is to provide an apparatus that allows for the improvement of the working conditions thanks to a reduced scattering of the refractory mass by the sand-blast head during the lining process effected from the top.

Still another object of the present invention is to provide an apparatus for effecting the above method, that makes it possible to minimize auxiliary and preparatory operations during lining and, therefore, to raise the efficiency of the apparatus.

Yet another object of the present invention is to provide an apparatus that allows to dispense with the use of patterns inserted into the ladle and technological operations involved thereby.

Still another object of the present invention is to provide a relatively general-purpose apparatus applicable for filling linings of diverse parameters in ladles and furnaces of various types and sizes.

These and other objects are accomplished in that, in accordance with the present invention, the apparatus for lining ladles with a refractory mass lies in that the mass is fed into the space confined by the inner surface of the ladle and the backing element by means of a sand-blast head moved along the inner circumferential perimeter of the ladle, to form a lining layer, and in addition to its movement along the inner circumferential perimeter the head is simultaneously and continuously moved along the height of the ladle, the distance between the sand-blast head and the lining surface being maintained constant, thereby ensuring a continuous and successive filling of the lining along a helical line over the entire height of the ladle.

Thus, by maintaining constant the distance from the sand-blast head to the prevailing surface of the lining, the latter has a higher quality (uniform density) as, when being thrown over a short distance, the refractory mass flow is not reflected by the walls of the ladle and pattern, is not slowed down due to air resistance, falls with a higher density and, consequently, delivers a stronger blow because in the course of a short-distance flight it has no time to scatter into fragments and the aerodynamic resistance is comparatively low.

During the course of lining the refractory mass fed into the said space, the mass is subjected to the simultaneous action of at least two active forces, of which one is the impact force developed by the sand-blast head and applied along the ladle wall being lined and parallel thereto, and the other one is applied in the direction normal to the ladle wall in the area where the lining is being tramped.

Simultaneous application of two active force attibutes to additional tramping of the refractory mass in the space, thereby improving its quality.

The apparatus for lining ladles with refractory comprises at least one sand-blast head with a mechanism for rotation thereof, and a backing shaping element connected to the sand-blast head to move together therewith, according to the present invention, comprises an adjustable mechanism for the continuous movement of at least one sand-blast head along a helical line over the ladle surface being lined, and a mechanism for controlled movement of the sand-blast head together with the shaping support in the direction normal to the plane of the lining layer being filled.

This permits the dispensing of the use of common patterns and, consequently, their manufacture, installation in the ladle, centering in the latter and subsequent removal therefrom. Therefore, the operating area for storing the patterns becomes unnecessary, the time required for preparatory and auxiliary operations is reduced, the hoisting equipment for handling the patterns is no longer needed, and the amount of manual operations is decreased. All this makes it also possible to make linings of any desired profile or taperness.

In accordance with one of the variants of embodiment of the invention the apparatus comprises a turnable platform disposed in the lower portion of a vertical supporting rod, placed inside the ladle being lined, and provided with a carriage mounting at least one sand-blast head which is continuously supplied with the refractory mass and provided with a drive to continuously move the rod together with the platform in the vertical direction and, simultaneously, to rotate the turnable platform about the vertical rod axis.

This embodiment, by employing most rational constructive elements, permits the carrying out of the method for lining ladles as claimed in U.S. Pat. No. 4,094,938, to have a constant distance between the sand-blast head and the actual plane of lining, and to line ladles of various types and sizes.

In accordance with another variant of embodiment of the present invention the apparatus is characterized in that the supporting rod is made hollow, and a belt conveyer is installed at the point of the outlet from the hollow rod, said conveyor supplying the refractory mass fed through the hollow rod to the sand-blast head.

The hollow rod serves a double purpose and is used as a rod for raising the platform with the sand-blast head and as a pipe through which refractory mass is fed to the belt conveyer without any difficulties encountered in the case when the rod is stationary and the conveyer moves relative to the vertical axis of the rod.

In accordance with still another variant of embodiment of the present invention the shaping element is provided with rotating rollers whose axes are disposed vertically relative to the ladle surface being lined, and are embraced by a flexible band in such a manner that the element can freely move on the rollers when the shaping element is rolling over the lining being filled, the shaping support being connected to the carriage of the turnable platform by means of a joint whose working axis is normal to the support surface of the band of the shaping element, the shape of the operating surface of the shaping support being identical to the circumferential line of the lining.

This embodiment of the rotating rollers embraced by the flexible band makes it possible not to damage the lining due to elimination of the band slippage over the lining when the shaping support rotates together with the platform and the sand-blast head relative to the former, while employment of the joint allows the shaping support to self-adjust while moving along the helical line.

Besides, in accordance with the present invention, the hollow rod may be made of a box-like rectangular cross-section, and have toothed racks disposed along its entire length at the opposite edges to mount the rod lifting mechanism, the rod having prismatic guides fastened to the rod angles, and the support race having guiding rollers oriented along the diagonals of the rod cross-section and interacting with the guides during the vertical rod movement.

In this constructive embodiment the toothed racks are used to ensure reliability and simplicity of operation, and the prismatic guides are mounted at the angles to make the rod more rigid, and to sustain the load through more rigid elements of the rod cross-section. The guiding rollers of this cross-section protect the rod against variable torques when the platform is rotating together with the sand-blast head, decrease the number of the rollers employed, and ensure a high-quality centering of the rod relative to the vertical axis of the apparatus during the assembly of the latter.

In accordance with yet another embodiment of the invention the sand-blast head and the elements connected thereto are mounted on the edge of the carriage so that it can move diametrically relative to the ladle being lined.

This makes it possible to line ladles of various types and sizes, and besides, to make local changes in the lining being made.

In accordance with another embodiment of the present invention, the carriage has an overhanging lever secured turnably in the dimatrical plane of the platform, having at its end a contact shoe sliding over the lining surface, and its other end connected to a sensitive selsyn-instrument effecting in its turn control over the rate of the platform rotation in such a manner that in the case of deviation of the lining plane and turn of the over-hanging lever the speed of the sand-blast head circumferential movement is accordingly changed.

This provides for automation of the process of control over the apparatus, for example, automatic maintenance of a constant level of the lining surface at any time with respect to the shaping support.

And, finally, in accordance with the invention, the carriage has a collapsable knife secured in the zone of the sand-blast head and extendable radially into an operating position to cut off in plane a part of the lining during the platform rotation.

This allows to mechanize preparation of planning the upper layer of the ladle lining to be covered with one or two rows of refractory bricks, and improves the quality of the lining-brick joint, and planning it provides the plane with a certain profile.

The following detailed description of an exemplary embodiment of the present invention is given with reference to the accompanying drawings, in which.

Figure 1:
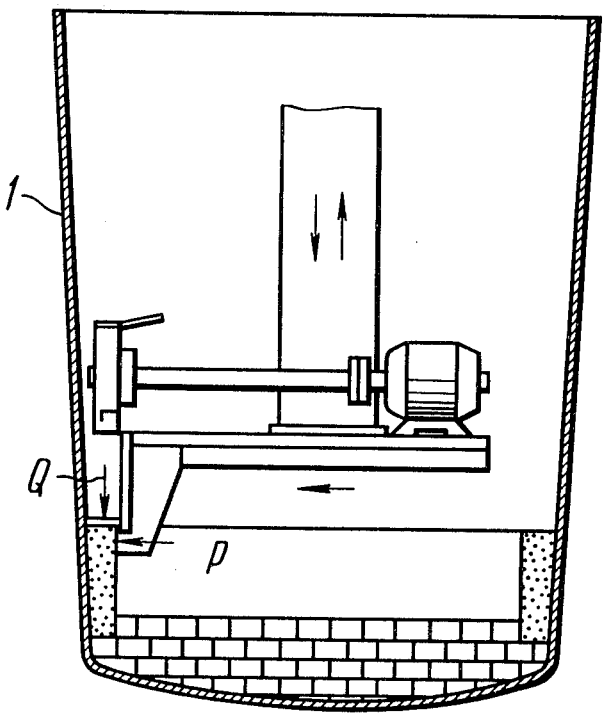
FIG. 1 is a schematic illustration clarifying the inventive apparatus for lining ladles and shows the forces acting on the lining layer being filled.

In order to obtain a high-quality working layer of the lining owing to increased density of the latter, it is suggested to tramp the lining by applying simultaneously at least two active forces, of which one is an impact force Q (FIG. 1) developed by the sand-blast head and applied from above perpendicularly to the layer being filled along the lining wall of a ladle 1, and the other is a force P applied to the direction normal to the wall of the ladle 1 and developed by a special shaping support in the zone of action of the impact force Q.

These forces tramp the refractory mass in a space confined by the wall of the ladle 1 and the special shaping support, as it will be clarified below.

Figure 2:
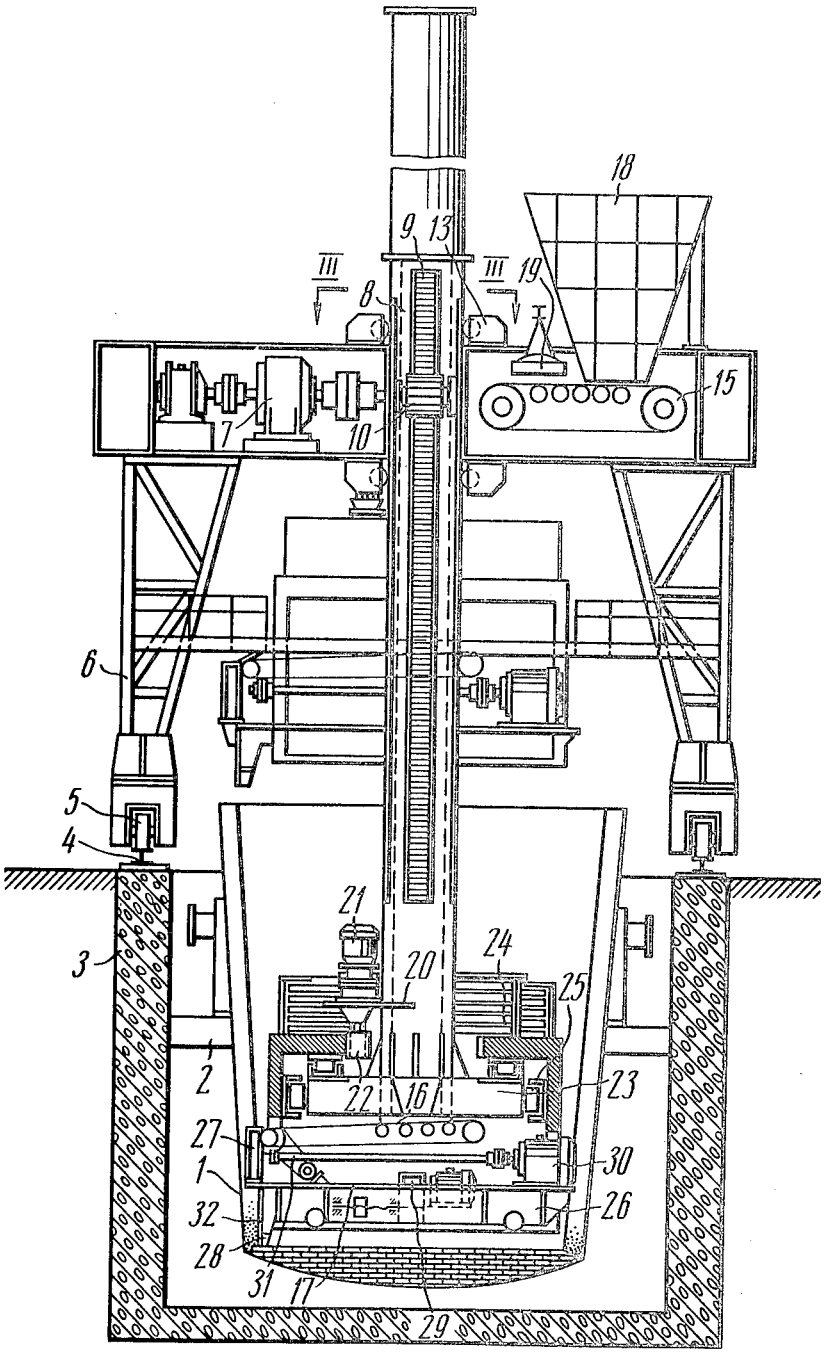
FIG. 2 shows an apparatus for lining ladles, according to the invention, being a general view at the beginning of the operating position.

An object that is to be lined, in this particular case the steel-teeming ladle 1 (FIG. 2), is mounted on support beams 2 of a pit 3 for servicing ladles. Laid on the base walls of the pit 3 is a rail 4 over which roller carriages 5 of a gantry 6 move.

The gantry 6 is essentially an assembled metallic structure consisting of separate metallic elements. All the metallic elements of the gantry 6 are welded from plate steel material, and the gantry 6 proper serves as a basis on which all the units of the apparatus are mounted.

Mounted on the upper platform of the gantry 6 is a drive 7 of a mechanism for vertical displacement of a rod 8. The rod 8 is essentially a hollow welded metallic structure of a rectangular cross-section, and it has reinforcing ribs and toothed racks 9 disposed on its opposite edges along the whole length of the rod 8, for displacement and engagement with gears wheels 10 of the drive 7 of the mechanism for vertical displacement of the rod 8.

Figure 3:
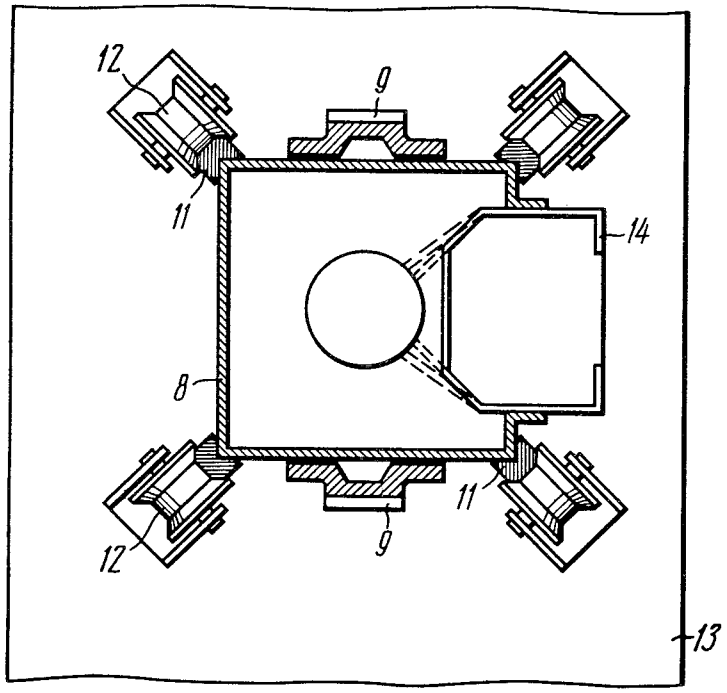
FIG. 3 shows a cross-section of the rod with the race of the apparatus as shown in FIG. 2.

Fastened to the angles of the rod 8 (FIG. 3) along the whole length of displacement of the rod 8 are prismatic guides 11 that hold the rod and all the mechanisms disposed thereon in the vertical position by means of guiding rollers 12 oriented along the diagonals of the rod 8 cross-section and secured in a race 13 mounted on the upper platform of the gantry 6. Provided on the hollow rod 8 is a vertical box 14 ensuring a supply of refractory mass from a batching feeder 15 (FIG. 2), disposed on the upper platform, to a belt conveyer 16 arranged under the rod 8 on a turnable platform 17.

The batching feeder 15 is designed to continuously feed a predetermined amount of refractory mass from a bin 18 into the hollow rod 8.

Arranged above the batching feeder 15 is a displacable electromagnet 19 designed to remove ferromagnetic metallic objects from the moving flow of the refractory mass.

Provided on the lower portion of the rod 8 is a support 20 (FIG. 2) bearing a drive 21 of a mechanism 22 rotating the turnable platform 17, this mechanism operating on the principle of internal gear engagement.

The hollow rod 8 terminates in a support plate 23 having a circular collector 24 fastened thereto and is used for supplying electric energy to the drives of the mechanisms disposed on the turnable platform 17, and thrust balancing rollers 25 resting loads during rotation of the turnable platform 17.

The turnable platform 17 is provided with guiding rails (not shown in FIG. 2) disposed in the lower portion thereof, over which rails a carriage 26 mounting at least one sand-blast head 27, the belt conveyer 16 and a shaping support 28 are moved by a mechanism 29 for diametrical movement of the carriage 26.

By its design the sand-blast head 17 is analogous to a conventional sand-blast head, and differs from the latter only by disposition of the port for charging refractory mass on the head housing and the way in which the sand-blast head is fastened to the frame of the carriage 26, which is necessitated by the fact that the sand-blast head 27 is to be disposed as close to the ladle 1 wall as possible.

The sand-blast head 27 is rotated by an electric motor 30 connected to the sand-blast head 27 via an intermediate shaft 31.

The belt conveyer 16 mounted on the carriage 26 of the turnable platform 22 is disposed at the point of outlet of the rod 8 and ensures constant receipt of refractory mass from the rod 8 during rotation of the turnable platform 22 and its supply into the sand-blast head 27.

Figure 4:
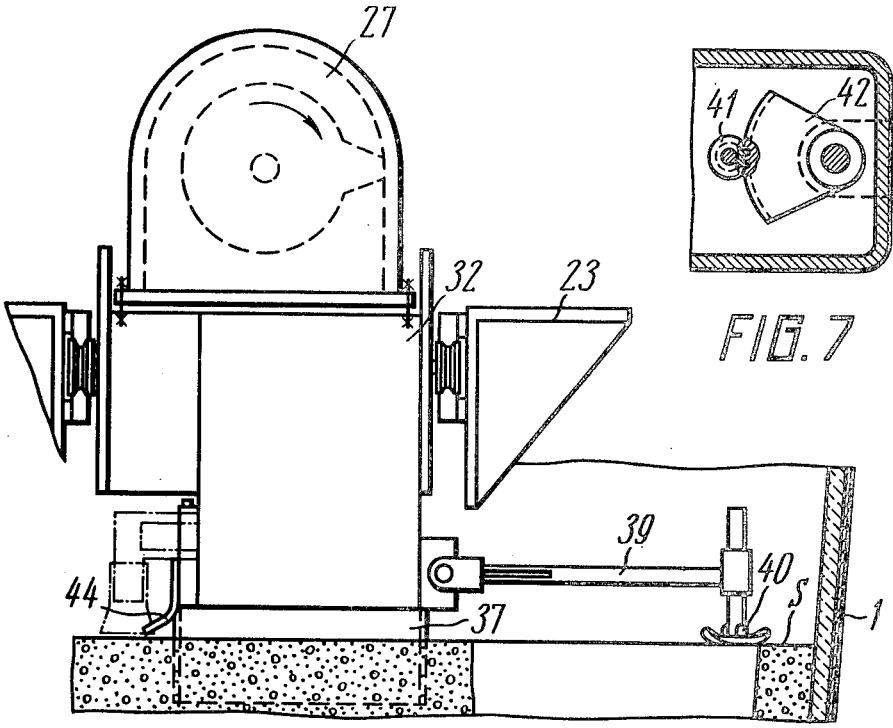
FIG. 4 shows a view of the sand-blast head with a shield, shaping support and sensor of the control of the level of the lining variable plane with respect to the shaping support in the apparatus as shown in FIG. 2.

Provided on the frame of the carriage 26 under the sand-blast head 27 is a flow of refractory mass from that head. A sheet 32 (FIG. 4) of a certain length is shaped along the circumferential line of the lining being filled, and can be disposed relative to the wall of ladle 1 in order to obtain a lining layer of a minimal thickness.

Mounted under the guiding sheet 32 is the shaping support 28 intended for obtaining the necessary space between wall of the ladle 1 and the shaping support 28 to be filled with the refractrory mass thrown out by the sand-blast head 27, and serving as a local gauge moving together with the sand-blast head 27.

Depending on the type and properties of the refractory mass used, the shaping support 28 can be of any embodiment.

Figure 6:
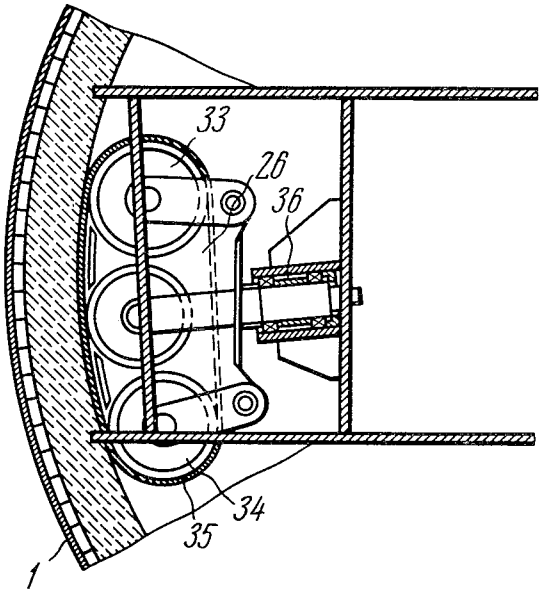
FIG. 6 shows a band shaping support, according to the invention, in the apparatus as shown in FIG. 2.

For example, the shaping support can be made as rotating rollers 33, 34 (FIG. 6) oriented by their axes parallel to the generating line of the surface of the ladle 1, and the lining being filled embraced by a flexible band 35 in such a manner that it can move freely over the rollers 33, 34 when the shaping support 28 rolls over the lining being filled. The shaping support 28 is connected to the carriage 26 of the turnable platform 17 by means of a joint 36 whose operating axis is normal to the support surface of the flexible band 35 of the shaping support 28 whose shape is identical to the circumferential line of the completed lining.

This design of the shaping support 28 allows the flexible band 35 of the shaping support 28 to roll over the working layer of the lining without damaging the latter, whereas the joint connection of the shaping support 28 with the carriage 26 makes it possible for the shaping support 28 to self-adjust during the movement of the turnable platform 17 by the helical line.

Figure 5:
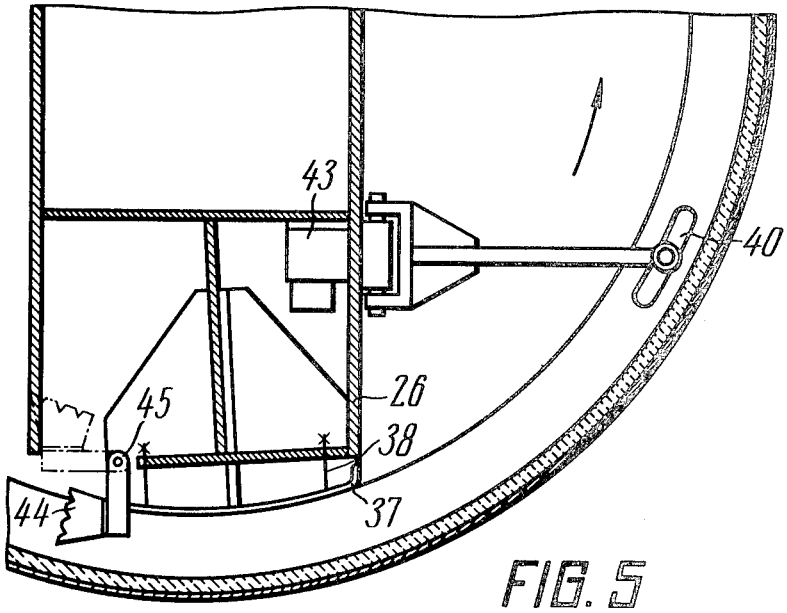
FIG. 5 shows a cross-section taken along line V—V in FIG. 4.

In the case of a fine refractory mass of a sufficient moulding softness, use is made of a shaping support 37 (FIGS. 4,5) made from a rigid wear-resistant metallic shield shaped along the circumferential line of the lining being filled. The base of the shaping support 37 (FIG. 5) is secured to the carriage 26 by means of special bolts 38 which permits orientation of it in any required position with respect to the surface of the lining being filled.

Figure 7:
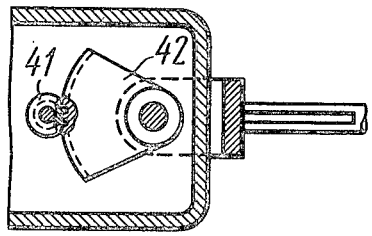

When the lining is being filled the operator is to maintain a constant distance between the sand-blast head 27 and the variable surface 8 of the lining being filled over its entire perimeter. In doing this he gets help from the sensor of the level of the instantaneous surface of lining, mounted on the carriage 26 (FIGS. 4,5) and made as an overhanging lever 39 made turnable in the diametrical plane of the platform 22, and having a contact shoe 40 attached to its free end and sliding over the surface S of the lining at any time, and its other end connected through a toothed engagement 41, 42 (FIG. 7) with a sensitive instrument 43 (FIG. 5) which, in its turn, effects control over the speed of movement of the turnable platform 2.

The contact shoe 40 of the sensor of the level of the instantaneous surface of the lining is extended forward with respect to the shaping support with the sand-blast head 27 in order to take into account the time lag of actuation of the drive of the mechanism for rotation of the turnable platform 22.

Provided from the rear side of the sheet 32 in the zone of the sand-blast head 27 is a collapsible gliding knife 44 (FIGS. 4,5) designed to cut off the upper portion of the lining to make it fit one or two rows of refractory bricks. The cutting is effected during the reverse rotation of the turnable platform 22. The blade of the knife 44 is of a tooth-like shape, which makes it possible to obtain a rough surface after the upper layer is cut off, which attributes to an improved fitting of the brick row and the filled lining. The collapsable gliding knife 44 is brought from its operating radial position into the non-operating one with the aid of a joint 45 specially provided for the purpose.

The apparatus operates as follows:

The ladle 1 is placed onto the support beam 2 of the service pit 3, and is centered thereon in such a way that the axis of the ladle 1 coincides with the axis of the rail 4. By means of the driven roller carriages 5 mounted on the gantry 6, the apparatus moves onto the ladle 1 and stops thereon in such a manner that the vertical axis of the rod 8 coincides with the vertical axis of the ladle 1. With the drive 7 switched on, the rod 8 and the support plate 23 of the turnable platform 17 move down towards the bottom of the ladle 1 and the shaping support 28 (in which case the terminal switch operates at the lowermost position, not shown in FIG. 2).

During the lowering of the rod 8 there is set up the necessary space or gap between the protective lining of the ladle 1 and the shaping support 28, which is attained as a result of the diametrical movement of the carriage 26 with the sand-blast head 27 mounted thereon by means of the mechanism 29 for diametrical movement of the carriage 26.

When the test rotation of the turnable platform 17 in the ladle 1 is terminated, the drive 21 of the mechanism 22 is switched on to provide the optimum mode of operation, and so are the mechanisms for supplying the refractory mass.

Then, the batching feeder 15 is switched on to feed refractory mass from the bin 18 (the bin 18 is loaded with refractory mass beforehand) into the vertical box 14 of the rod 8. In the course of its movement through the batching feeder 15 the refractory mass is cleaned of ferromagnetic materials with the aid of the electromagnet 19.

Through the vertical box 14 the refractory mass gets onto the belt conveyer 16 which delivers it into the sand-blast head 27. The operating member, i.e. the rotor (not shown) of the sand-blast head 27 is rotated by the electric motor 30 through the intermediate shaft 31. The sand-blast head 27 disposed on the carriage 26 of the turnable platform 17, together with the shaping support 28, feeds the refractory mass into the space between the wall of ladle 1 and the shaping support 28 until the height of the lining equals that of the shaping support 28. Hereafter, the drive 7 is switched on, and the rod 8 is imparted upward movement through the gears 10 and the racks 9. Concurrently, the drive 29 with the sand-blast head 27 and the shaping support 28 is switched on, and the ladle 1 is started being lined along the helical line, with the radius of the lining increasing as the rod 8 moves higher.

On getting into the sand-blast head 27 (FIG. 1) the refractory mass is started being tramped in the space confined by the wall of ladle 1 and the shaping support 28 mounted under the sand-blast head 27 by two active forces of which one is the impact force Q developed by the sand-blast head 27 and applied perpendicularly to the upper surface of the lining being filled, and the other force is designated P, developed by the shaping support 28 and applied in the direction normal to that of the impact force Q in the zone of the lining being filled. The distance between the sand-blast head 27 and the prevailing surface of lining remains optimal constant, and is determined by the dimensions of the sheet 32.

In order to maintain constant the distance between the sand-blast head 27 and the variable surface of lining, which may vary for reasons that do not depend on one another (non-uniform supply of the mass, inaccurate centering of the apparatus with respect to the ladle), the contact shoe 30 (FIGS. 4,5) fastened to the overhanging lever 39 moves over the surface of the lining being filled and, in the case of deviations in the level of the surface S of the lining being filled with respect to the shaping support 28, starts vibrating, thereby bringing into rotation the sensitive instrument 43 through the toothed sector 42 and the gear wheel 41 mounted on the shaft of the instrument 43. In the case of downward deviation of the feeler with the lever 39 from the nominal value, the shaft of the instrument 43 will rotate in one direction, and in the case of upward deviation, in the other.

By electrical signals received due to oscillations of the contact show-feeler 40, the instrument 43 either increases or decreases the circumferential speed of movement of the sand-blast head 27, as a result of which the variable surface S (FIG. 1) of the lining being filled is levelled up with respect to the shaping support 28. As the amount of the refractory mass thrown by the sand-blast head 27 onto the surface S of the lining per time unit is always constant, it is possible by changing the speed of circumferential movement of the sand-blast head 27 to vary the amount of the mass thrown onto the variable surface S of the lining by levelling up and maintaining constant the level of the surface of the lining layer being filled with respect to the shaping support 28.

In the course of the lining of a ladle there is obtained a uniform density of tramping of the refractory mass over the entire height of the ladle owing to the fact that the refractory mass is tramped by the sand-blast head 27 in such a way that the distance between the sand-blast head 27 and the surface S of the lining (FIG. 1) remains constant, and the mass is additionally tramped by the shaping support 28 whose force is applied from the side of the lining operating layer.

The density of lining after the tramping process varies within narrow limits, and constitutes 95 to 97 units as measured by the Foundary Hardness Meter.

In the course of their use the linings of ladles wear out non-uniformly over the height of the ladle, and, therefore, it is expedient to make its thickness different along the height of the ladle, i.e. to make it thicker in the spot of more intensive wear-out of the lining and thinner in the spots of less intensive wear-out.

For this purpose the apparatus for lining ladles is provided with the carriage 26 having the mechanism 29 for diametrical movement, mounted on the turnable platform 17.

The mechanism 29 allows for a fast change in the radius of circumferential movement of the sand-blast head 27 with the shaping support 28 relative to the vertical axis of the rod 8 and, thus, to obtain the required profile of the lining being filled.

With the lining process over, the mechanisms for supplying the refractory mass and the sand-blast head 27 are switched off, the gliding knife 44 is brought by means of the joint 45 from its non-operating position into the radial operating position, and, by rotating the turnable platform 17 in the direction opposite to the operating one and simultaneously lowering the rod 8, the upper layer of the lining is cut off (planed) until the surface is levelled up over the entire perimeter of the ladle to make it possible to place one or two rows of refractory bricks. Thereupon the movement of the turnable platform 17 is discontinued, the rod 8 is raised in its extreme upper position, the terminal switch (not shown in the drawings) starts operating, and the apparatus for lining ladles moves off the service pit, to be prepared for lining another ladle.

Control over the actuating mechanisms of the apparatus is effected by means of universal switches, knob stations and control knobs disposed on two control panels (not shown) of which one is the main and the other is auxiliary.

The electric control circuit provides for possibility of controlling the apparatus both in adjusting and automatic modes of operation.

In the case of the adjusting mode of operation all the actuating mechanisms are switched on autonomously in order to check their operability and to adjust the apparatus for filling a lining of a required profile in a ladle of a certain type and size.

In the automatic mode of operation the apparatus is controlled from a central control board (not shown).

The automatic mode of operation provides for switching on of necessary interlocks (the driven roller carriages 5 of the gantry 6 are switched off).

The sand-blast head 27, the belt conveyer 16 and the batching feeder 15 are switched on in a required sequence automatically, wherein in case one of the mechanisms is not switched on the other mechanisms connected with it by the technological sequence are automatically interlocked from being switched on.

The electric control system provides for an emergency switch off of the actuating mechanisms of the apparatus.

The electric control circuit of the actuating mechanisms provides for their operation within a wide range in accordance with the required technical characteristics of the apparatus, from which some data can be cited as an example.

The output of the sand-blast head in the case of untramped mass is 40 $m^3$/hr. The refractory mass jet is thrown out of the sand-blast head at a rate of 60 m/sec. The power of the electric motor of the drive of the operating member of the sand-blast head is 100 Kwt. The (controllable) speed of the vertical displacement of the rod is 0.1 to 0.4 m/min, with the rod pitch being 4100 mm. The (controllable) rotation rate of the turnable platform is 2 to 7.5 rpm. The speed of the gantry movement is 10 m/min. The time required for lining a 160 t ladle is 1 hour 30 min. The minimum thickness of the lining working layer is 160 mm, the maximum thickness of the layer being 260 mm. Use is made of refractory mass having a humidity of 6 to 9% based on natural refractory sand.

In order to obtain a high-quality working layer of a ladle wall lining, it is necessary to observe the following technological requirements set forth with respect to both the refractory mass used and the modes of the apparatus operation.

The refractory mass should be fine and uniform, have a humidity of 7 to 9% and be based on natural refractory sand with a clay content of around 12%.

The refractory mass should be uniformly delivered from the bin in an amount providing for sufficient loading of the sand-blast head, operating at a rate of 40 $m^3$/hr.

The rotation drive of the turnable platform 22 should ensure a stable speed of the circumferential movement of the turnable platform within its range, both under load and without it.

The lifting drive of the rod 8 should ensure uniform lift of the rod both under load and without it.

What we claim is:

1. Apparatus for the high-density lining of inner spaces, confined by the inner surface of a ladle and by a back shaping element therein, with a refractory mass along the inner circumferential perimeter of the ladle wall surface and along the entire height thereof, comprising:

at least one blasting means, and means for rotating said blasting means and simultaneously and continuously moving said blasting means radially with respect to the surfaces being lined, together with said back shaping element to thereby obtain a continuous filling of the lining along the ladle wall surface being lined;

feeding means for feeding the refractory mass into spaces confined between the inner surface of said ladle and said back shaping element;

said feeding means including said blasting means and means to apply the fed-in mass to the inner surface with said at least one blasting means in close proximity to the inner ladle perimeter with a force which is applied perpendicularly to the upper surface of the lining layer as the lining is applied;

means to position said back shaping element initially at a distance equal to the initial thickness of the lining in the bottom of the ladle and behind said blasting means free of physical contact from the inner perimeter of said ladle to ensure a predetermined narrow gap being filled with the refractory mass along the ladle wall being lined into said space between said ladle wall and said shaping element;

means for imparting to said blasting means and said back shaping element a continuous circular and continuous vertical movement along the inner perimeter and parallel thereto and along the entire height of said ladle as the lining is completing the perimeter, said back shaping element and said blasting means being moved upwards together and continuously, in addition to and simultaneously with its continuous circular movement along the inner ladle perimeter, to thereby obtain the continuous and a successive filling of the lining along a helical line over the ladle wall surface being lined;

said positioning means including means for maintaining the distance between said blasting means and the upper surface of the lining constant during the vertical movement to create identical conditions for the passage of the refractory mass applied by said blasting means; and, means for sensing deviations in the level of the upper surface of the lining as the fed-in mass is applied, and means to maintain the distance between said blasting means and the upper surface of the lining constant.

2. The apparatus as claimed in claim 1, wherein said feeding means includes a vertical supporting rod disposed inside the ladle being lined, a turntable platform fitted in the lower portion of said vertical supporting rod, and means for continuously feeding the refractory mass into said carriage, said carriage including an external support and a drive for continuous vertical movement of said rod together with said platform, and simultaneous rotation of the latter around the vertical axis of said rod.

3. Apparatus as claimed in claim 1, wherein said feeding means feeds the mass at a speed of 60 m/sec. along a helical trajectory.

4. Apparatus as defined in claim 1, further comprising:

means for compressing the refractory mass applied with said at least one blasting means, by the application of the impact force developed by said blasting means.

5. The apparatus as claimed in claim 1, wherein said rotating means includes a carriage, said blasting means includes a sand blast head, said feeding means includes said back shaping element carried by said carriage, and said positioning means includes means to move said carriage diametrically of said ladle for directing the refractory mass in a direction parallel to the inner circumferential wall solely with said blast head and directing the refractory mass transversely and normally towards the inner circumferential perimeter of the ladle wall solely with said back shaping element.

6. The apparatus as claimed in claim 5, wherein said imparting means includes a turntable platform for carrying said carriage, and means including a joint for connecting said shaping element to said carriage, said joint including means permitting said shaping support to self adjust to the lining while moving along with said platform along the helical line, said shaping element including a flexible continuous band having a shape identical to the circumferential line of the completed lining.

7. Apparatus as claimed in claim 1, including a hollow supporting rod for raising and lowering said blasting means forming part of said feeding means for feeding the refractory mass to said blasting means.

8. Apparatus as claimed in claim 7, wherein said feeding means includes a turntable platform and a belt conveyor on said platform movable relative to the vertical axis of said rod, said belt conveyor receiving the refractory mass for feeding thereof to said sand blast means.

9. Apparatus as claimed in claim 8, wherein said sand blast means includes a sand blast head and a carriage for said sand blast head and said conveyor, said sand blast head being mounted on an edge of said carriage so that said conveyor and said sand blast head are movable diametrically on said turntable platform relative to the ladle being lined.

* * * * *